US011226180B1

(12) United States Patent
Sullivan

(10) Patent No.: US 11,226,180 B1
(45) Date of Patent: Jan. 18, 2022

(54) BROADHEAD WITH BLADE DEPLOYMENT DAMPENING SYSTEM

(71) Applicant: Kevin M. Sullivan, Lakemont, GA (US)

(72) Inventor: Kevin M. Sullivan, Lakemont, GA (US)

( * ) Notice: Subject to any disclaimer, the term of this patent is extended or adjusted under 35 U.S.C. 154(b) by 0 days.

(21) Appl. No.: 17/018,384

(22) Filed: Sep. 11, 2020

Related U.S. Application Data

(60) Provisional application No. 62/935,453, filed on Nov. 14, 2019, provisional application No. 62/898,608, filed on Sep. 11, 2019.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 5,564,713 A * 10/1996 Mizek ..... F42B 6/08 473/583
6,165,086 A * 12/2000 Liechty, II ..... F42B 6/08 473/583
6,174,252 B1 * 1/2001 Mizek ..... F42B 6/08 473/583
6,287,224 B1 * 9/2001 Liechty, II ..... F42B 6/08 473/583
8,133,138 B1 * 3/2012 Hannah ..... F42B 6/08 473/583
9,052,170 B1 * 6/2015 Campbell ..... F42B 12/34

* cited by examiner

*Primary Examiner* — John A Ricci
(74) *Attorney, Agent, or Firm* — Akerman LLP; Michael K. Dixon

(57) ABSTRACT

A broadhead having one or more movable blades capable of moving between closed and open positions and having a blade shock absorption system configured to absorb forces generated within a movable blade moving from the closed position to the open position is disclosed. The blade shock absorption system cushions the blade as the blade moves to the open position from the closed position, thereby substantially reducing the likelihood of the blade being damaged when the broadhead strikes an animal and the blades are deployed form the closed position into the open position.

20 Claims, 10 Drawing Sheets

BROADHEAD WITH BLADE DEPLOYMENT DAMPENING SYSTEM

CROSS-REFERENCE TO RELATED APPLICATION

This application claims the benefit of U.S. Provisional Patent Application No. 62/898,608, filed on Sep. 11, 2019 and the benefit of U.S. Provisional Patent Application No. 62/935,453, filed on Nov. 14, 2019, which are both incorporated herein in their entireties.

FIELD OF THE INVENTION

This invention is directed generally to broadheads attachable to archery arrows used for hunting, and more particularly to mechanical broadheads having blades that move between open and closed positions.

BACKGROUND

Modern broadheads are tips attachable to a distal end of an arrow shaft and include one or more blades having cutting arrises. Modern broadheads are typically either a fixed blade broadhead or a mechanical blade broadhead. Mechanical blade broadheads include blades that move between open and closed positions. The closed position is used for blades during flight and before impact with an animal. Upon impact, the blades move from the closed position into the open position, whereby the cutting diameter is of the broadhead is substantially increased. In the open position, the blades extend outwardly from a generally cylindrical broadhead body. The blades typically extend from the broadhead such that the cutting arris of each blade are at an acute angle relative to a longitudinal axis of the broadhead body and extend from a distal point at an intersection at an outer surface of the broadhead body to near the tip at an outer surface of the broadhead body to a proximal point radially outward of the outer surface of the broadhead body. In this position, the blades are capable of cutting flesh as the broadhead passes through an animal.

SUMMARY

A broadhead having one or more movable blades capable of moving between closed and open positions and having a blade shock absorption system configured to absorb forces generated within a movable blade moving from the closed position to the open position is disclosed. The blade shock absorption system cushions the blade as the blade moves to the open position from the closed position, thereby substantially reducing the likelihood of the blade being damaged when the broadhead strikes an animal and the blades are deployed form the closed position into the open position.

In at least one embodiment, the broadhead for an arrow may include a body configured to be attached to a distal end of the arrow. The broadhead may include a tip forming a distal end of the body and one or more movable blades movably attached to the body. The movable blade may be configured to move between closed and open positions. The blade shock absorption system may be configured to absorb forces generated within the movable blade moving from the closed position to the open position. The blade shock absorption system may include one or more receivers and one or more dampening bodies positioned in at least a portion of the receiver. The receiver may be positioned such that at least a portion of the movable blade contacts the dampening body when the blade moves from the closed position to the open position.

In at least one embodiment, a longitudinal axis of the receiver may be aligned with a longitudinal axis of the body. A longitudinal axis of the receiver may also be orthogonal to a longitudinal axis of the body. A longitudinal axis of the receiver may also be nonorthogonal and nonparallel to a longitudinal axis of the body. The receiver may have different configurations. The receiver may be a slot with at least one open side. The receiver may be a hole with an opening in at least one end of the hole or any shape sufficient to receive the dampening body and position the dampening body in the path of the blade moving between the closed and open positions.

The dampening body may be removably positioned in the receiver. The dampening body may be a crushable material. The dampening body may be a monofilament. The receiver may be positioned between a point at which the movable blade is movably attached to the body and a proximal end of the body. The movable blade may also include a protrusion extending therefrom and positioned to contact one or more dampening bodies of the blade shock absorption system when the blade is moved from the closed position to the open position, such as when the broadhead strikes a target, such as an animal.

In at least one embodiment, the broadhead may include a plurality of movable blades. The broadhead may include a blade retention system configured to retain the movable blade in a closed position. The blade retention system may include a connector extending from the body through a plane of the movable blade to prevent deployment of the movable blade.

An advantage of this broadhead is that the blade shock absorption system cushions the blade as the blade moves to the open position from the closed position, thereby substantially reducing the likelihood of the blade being damaged when the broadhead strikes an animal and the blades are deployed form the closed position into the open position.

Another advantage of this broadhead is that the dampening body may be replaced after being used, thereby enabling the broadhead to be shot more than once and the blade shock absorption system still function properly.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
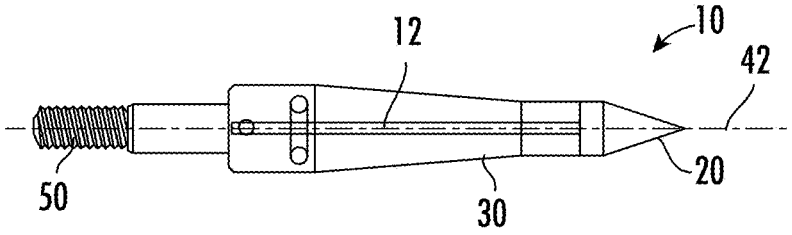
FIG. 1 is a top view of a broadhead attached to an arrow.
Figure 2:
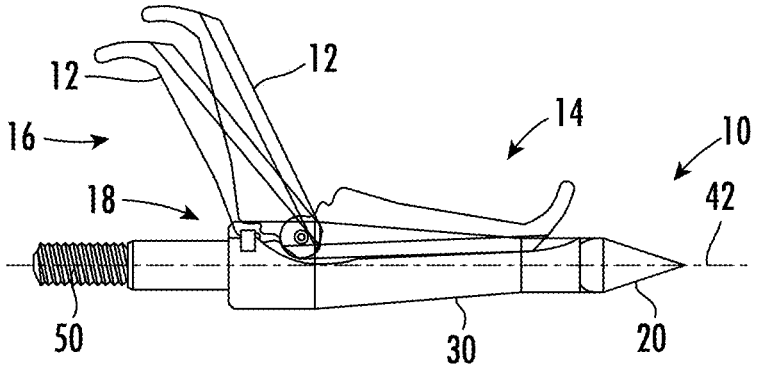
FIG. 2 is a side view of the broadhead with a blade being shown in the closed position, moving to the open position and in the open position.
Figure 3:
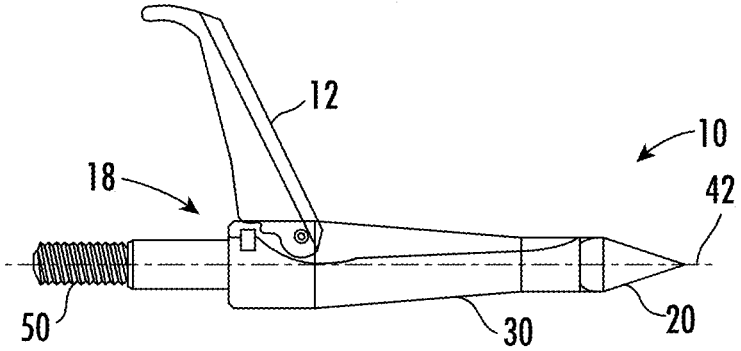
FIG. 3 is a side view of the broadhead with a blade in a position in which the blade is first contacting a dampening body of the blade shock absorption system.
Figure 4:
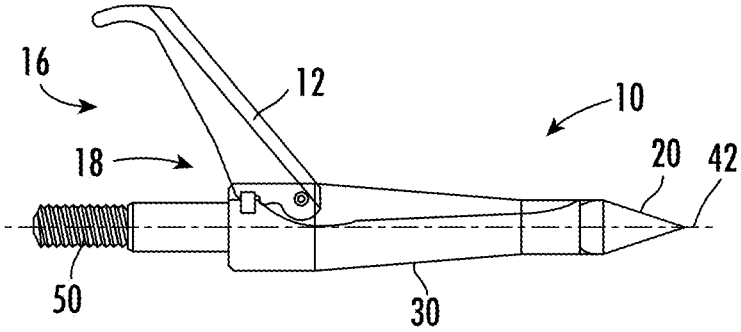
FIG. 4 is a side view of the broadhead with a blade moving into the open position.
Figure 5:
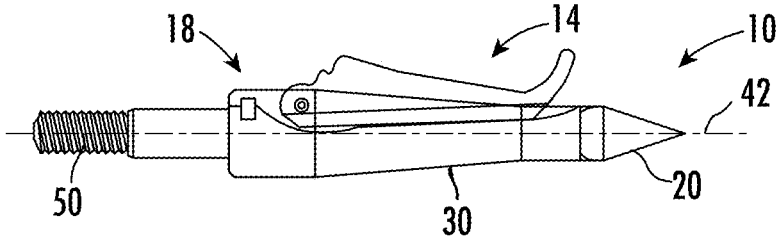
FIG. 5 is a side view of the broadhead with a blade in the closed position.

As shown in FIGS. 1-17, a broadhead 10 for an arrow 48 having at least one movable blade 12 capable of moving between closed 14 and open positions 16 is disclosed. In at least one embodiment, the broadhead 10 may include a plurality of movable blades 12. The broadhead 10 may include a blade shock absorption system 18 configured to absorb forces generated within a blade 12 moving from a closed position 14 to an open position 16. The blade shock absorption system 18 cushions the blade 12 as the blade 12 moves to the open position 16 from the closed position 14, thereby substantially reducing the likelihood of the blade 12 being damaged when the broadhead 10 strikes an animal and the blades 12 are deployed form the closed position 14 into the open position 16.

Figure 9:
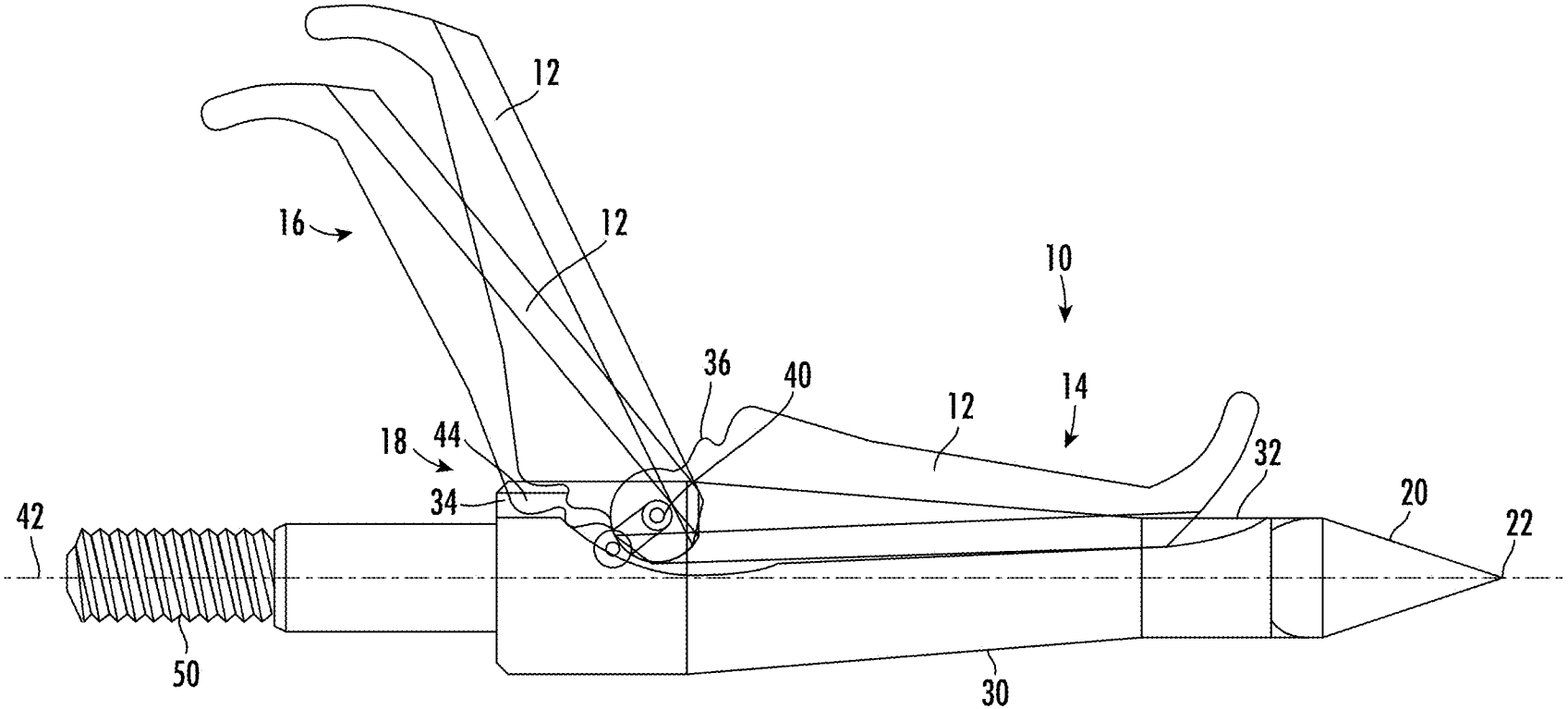
FIG. 9 is a side view of the broadhead with a receiver aligned with a longitudinal axis of the broadhead, whereby the receiver is a hole.

The broadhead 10 may include a tip 20 configured to facilitate penetration of the blade 12 into an object with a pointed distal end 22, as shown in FIG. 9. The tip 20 may be pointed and include any appropriate configuration facilitating penetration of the tip 20 into a target, such as an animal or other target. The tip 20 may taper from a point to a cylindrical aft section or have another appropriate cross-sectional shape. In one embodiment, the tip 20 may include three cutting arrises that extend from the point and are separated by surfaces. As such, the tip 20 may be is formed from a trocar having a plurality of cutting arrises. The number of cutting arrises may or may not correspond to the number of blades 12. In one embodiment, the pointed tip 20 may not have any cutting arrises. In another embodiment, the pointed tip 20 may have one or more cutting arrises. The blades 12 may be aligned with the cutting arrises. The tip 20 may be generally cylindrical or have another appropriate shaped outer surface.

The broadhead blade 12 or blades 12 may be configured to move between a closed position 14 and an open position 16. The cutting diameter of the broadhead 10 may be larger in the open position 16 than in the closed position 14. The blades 12 may be configured to be a rear-deploying system or a front-deploying system. In the front-deploying system, each blade 12 may be attached to the broadhead body 30 with a pin 40 about which the blade 12 is free to pivot. The pin 40 may be positioned closer to the proximal end of the broadhead 10 than the distal end. The blade 12, when in the closed position 14, may at least partially reside within a longitudinal extending slot 32.

The broadhead body 30 may be any appropriate shape in configuration. In at least one embodiment, the broadhead body 30 may be generally cylindrical and may have different tapers on an outer surface of the body 30. The broadhead body 30 may include one or more slots 32 generally aligned with the longitudinal axis 42 of the broadhead body 30 for receiving at least a portion of the moveable blades 12. The broadhead body 30 may be configured to be attached to an arrow 48 in any appropriate manner, such as, but not limited to, threads 50, glue-on connection, and an interference fit and may be releasably or permanently attached to an arrow 48.

The blade shock absorption system 18 may be configured to absorb forces generated within a blade 12 moving from a closed position 14 to an open position 16. The blade shock absorption system 18 may include a dampening body 34, such as, but not limited to being, a crushable material, positioned to be impacted by a broadhead blade 12 of any acceptable blade design for the purpose of decelerating a blade 12 upon impact. The blade shock absorption system 18 may include positioning a dampening body 34 behind (proximal to) a blade 12 to slow its movement at impact to eliminate hammering.

In at least one embodiment, at least a portion of the blade 12 may be positioned within the slot when the blade 12 is in the closed positioned 14. In at least one embodiment, the slot 32 may be configured such that a large portion of the blade 12 and a portion of or all of a cutting arris of the blade 12 may be positioned within the slot 32 in the closed position 14. A downstream edge of the blade 12, which may be on an opposite side of the blade 12 from the cutting arris, may include one or more components of the blade shock absorption system 18. In particular, the blade shock absorption system 18 may include at least one protrusion 36 extending generally radially inward from a proximal edge of the blade 12. However, the blade shock absorption system 18 is not limited to having a protrusion 36 but may be any configuration capable of facilitating a blade 12 contacting a crushable material when the blade 12 is moved upon impact from a closed position 14 to an open position 16. In another embodiment, the blade shock absorption may include a blade 12 with a flat surface 38 on a proximal edge of a blade 12 in an open position 16, whereby the flat surface 38 is configured to contact the crushable material. In the embodiment with the protrusion 36, the at least one protrusion 36 may be positioned proximal to the pin 40 pivotably attaching the blade 12 to the broadhead body 30.

Figure 13:
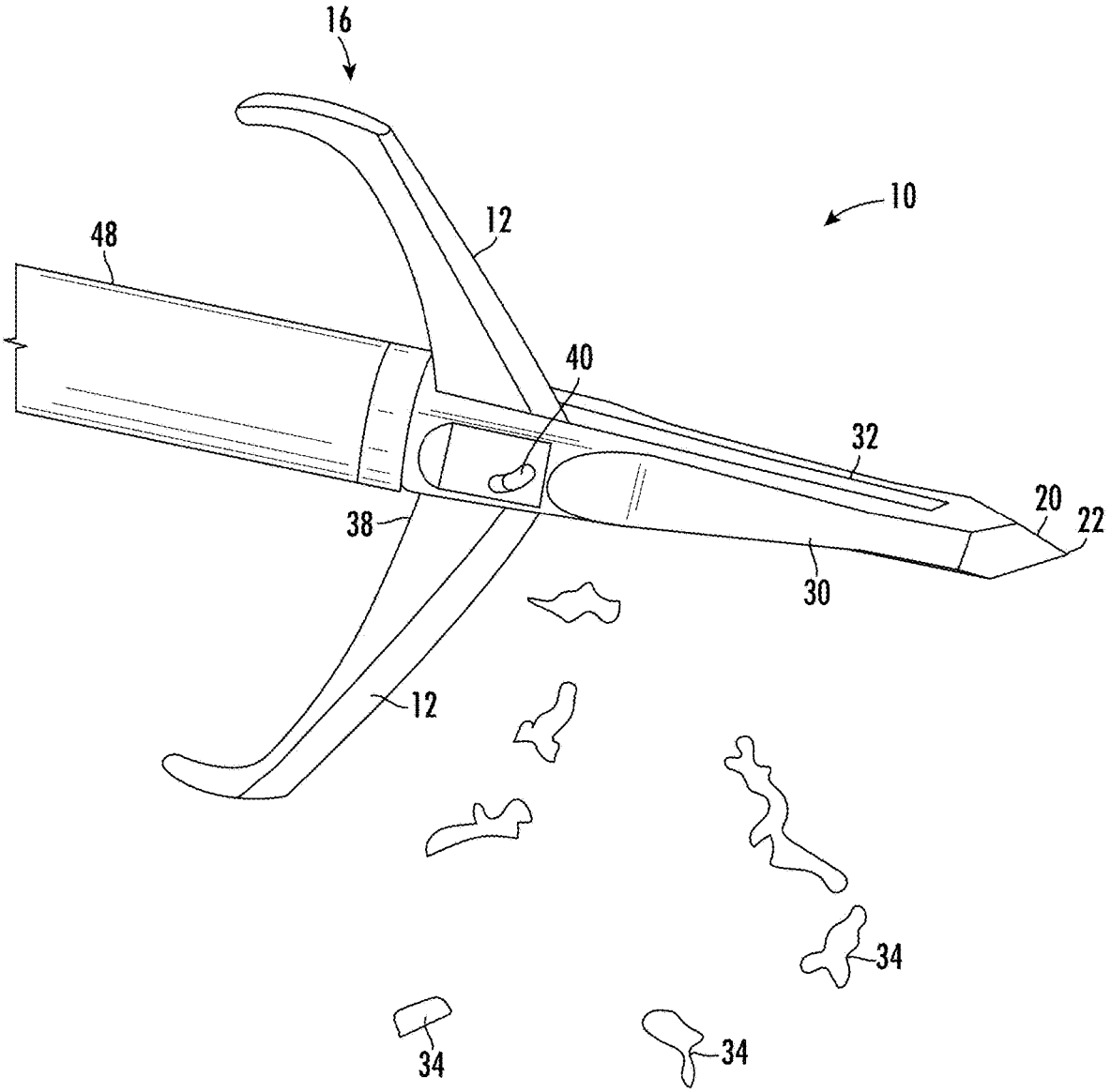
FIG. 13 is a side perspective view of a broadhead with deployed blades in the open position with used dampening bodies having been removed from the receivers and set upon a table surface and a single unused dampening body in the lower lefthand side of the figure showing the difference between an unused dampening body and used dampening bodies that have been crushed.

The broadhead body 30 may include a receiver 44 configured to receive and hold a dampening body 34 in such a position that when the blade 12 is moved between a closed position 14 and an open position 16, the at least one protrusion 36 on the blade 12 contacts the dampening body 34, thereby preventing the blade 12 from hitting an abrupt stop. Instead, the dampening body 34 absorbs some of the force from the blade 12 moving into the open position 16, thereby preventing the blade 12 from being damaged. In at least one embodiment, the dampening body 34 may be a piece of monofilament, such as between 0.15 mm and 3 mm in diameter. In at least one embodiment, the monofilament may be positioned such that the blade 12 strikes an end of the monofilament aligned with a longitudinal axis of the monofilament. In another embodiment, the monofilament may be positioned such that the blade 12 strikes a side surface of the monofilament, such that the direction of force exerted on the monofilament is orthogonal to the longitudinal axis of the monofilament. The dampening body 34 may be, but is not limited to being, monofilament, nylon, acrylic, Teflon, rubber, wax, soft metal, a crushable material or any material that is more malleable than a material used to form the blades 12. In at least one embodiment, the dampening body 34 may be formed from a one-time use material sufficient to effectively dampen deceleration of the blade 12. This material may be any one of those listed herein, one already conceived or heretofor yet to be conceived. The one-time use material, once used, may be deformed such that it is no longer usable as a dampening body 34, thereby referred to as a consumable material. Used dampening bodies 34 are shown in FIG. 13, except for the dampening body 34 shown in the lower lefthand side of FIG. 13. The dampening body 34 may be sized smaller than the broadhead body 30. In at least one embodiment, the dampening body 34 may be less than one half the size of the broadhead body 30. The dampening body 34 may be less than one quarter the size of the broadhead body 30. The dampening body 34 may be less than one tenth the size of the broadhead body 30.

Figure 6:
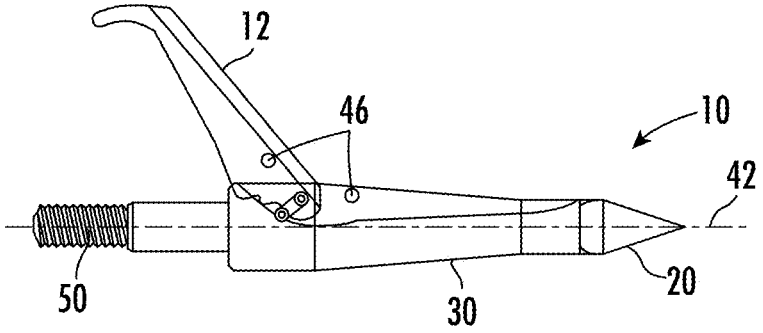
FIG. 6 is a side view of the broadhead with a blade in the open position with a blade retention system.
Figure 7:
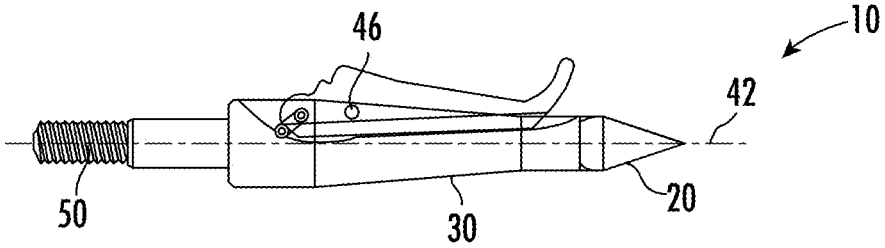
FIG. 7 is a side view of the broadhead with a blade in the closed position with a blade retention system preventing the blade from being moved such that a practice shot can be made with the broadhead without the blade deploying.
Figure 8:
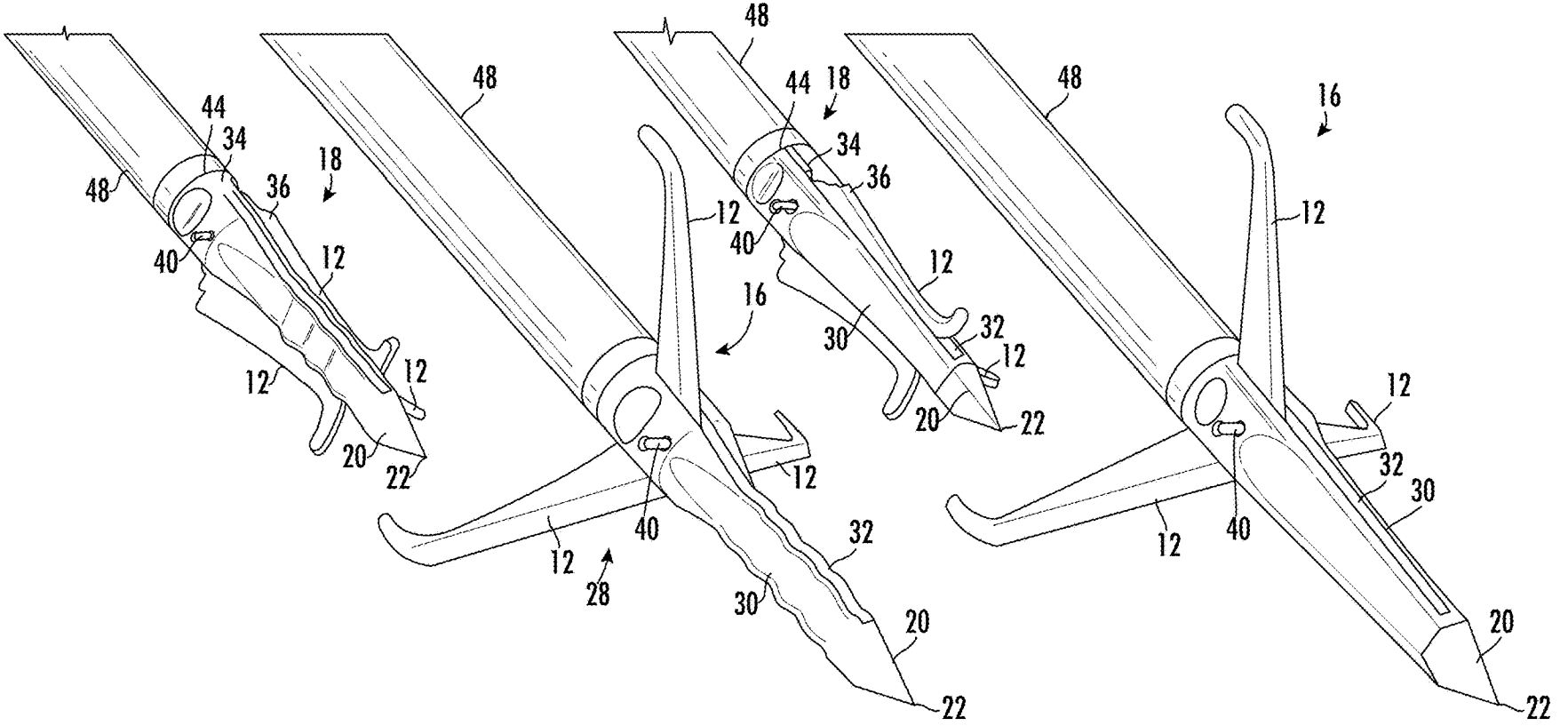
FIG. 8 is a perspective view of multiple broadheads with a plurality of blades with one broadhead being an in open position and another broadhead being in a closed position, which each broadhead having a receiver aligned with a longitudinal axis of the broadhead.

The broadhead 10 may include a blade retention system 46, as shown in FIGS. 6 and 7, configured to retain the blade 12 or blades 12 in a closed position 14, even when shot into a target. As such, the blade retention system 46 enables the same broadhead 10 that will be used to harvest an animal to be shot at a target in practice sessions to determine the actual flight of the arrow 48 with the broadhead 10 attached to be sure that the arrow 48 and broadhead 10 combination are accurate and fly true. The blade retention system 46 may also prevent the cutting arris of the blade 12 from contacting the target, thereby preventing the cutting arris from being dulled. The blade retention system 46 may be any device configured to retain the blades 12 in the closed position 14 without affecting arrow flight. In at least one embodiment, the blade retention system 46 may be formed from a screw configured to be positioned within a hole in the blade 12 and threadable attached to the broadhead body 30. The screw may be positioned within the broadhead body 30 and the blade 12 such that the screw does not extend radially outward past the outer surface of the broadhead body 30.

Figure 10:
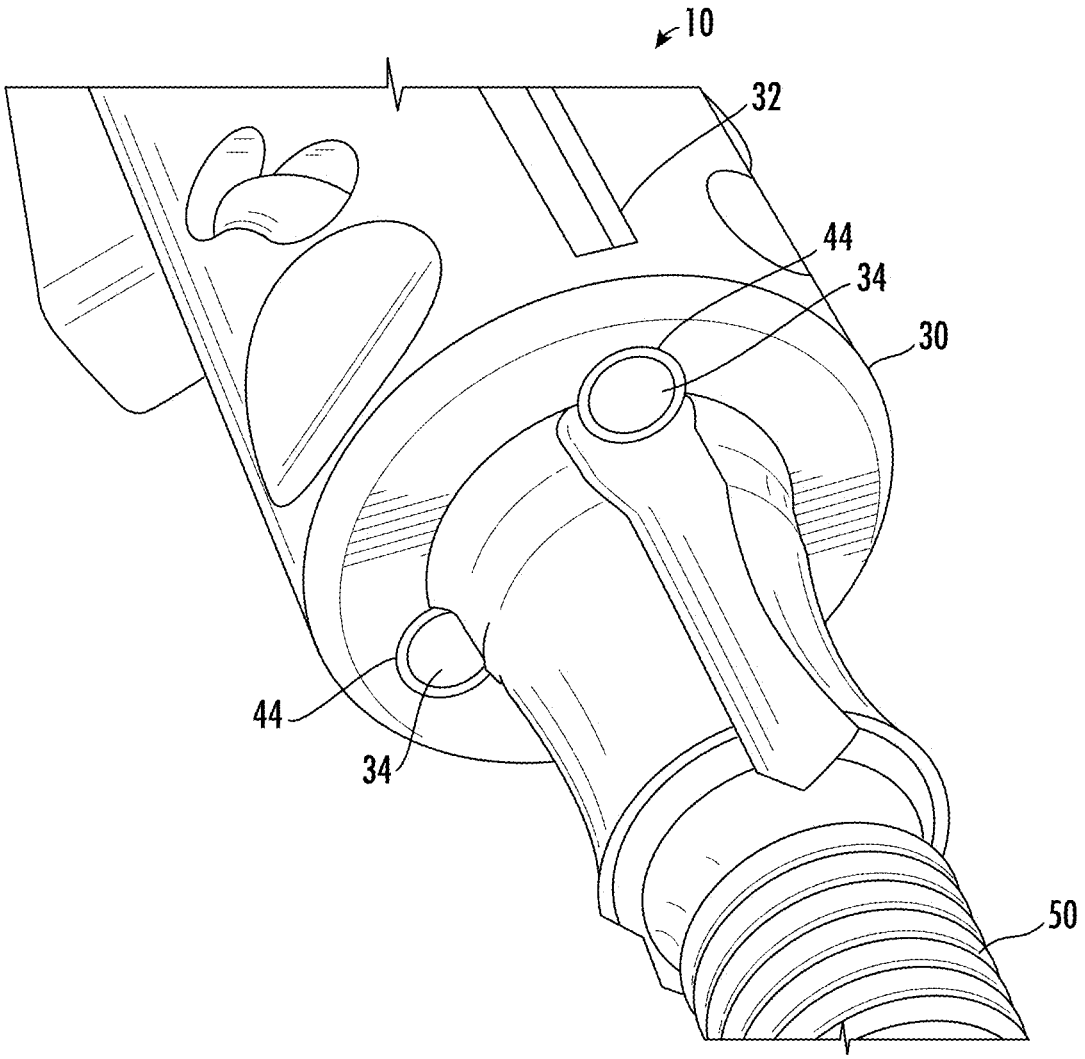
FIG. 10 is a rear perspective view of the broadhead with a receiver aligned with a longitudinal axis of the broadhead, whereby the receiver is a hole.
Figure 11:
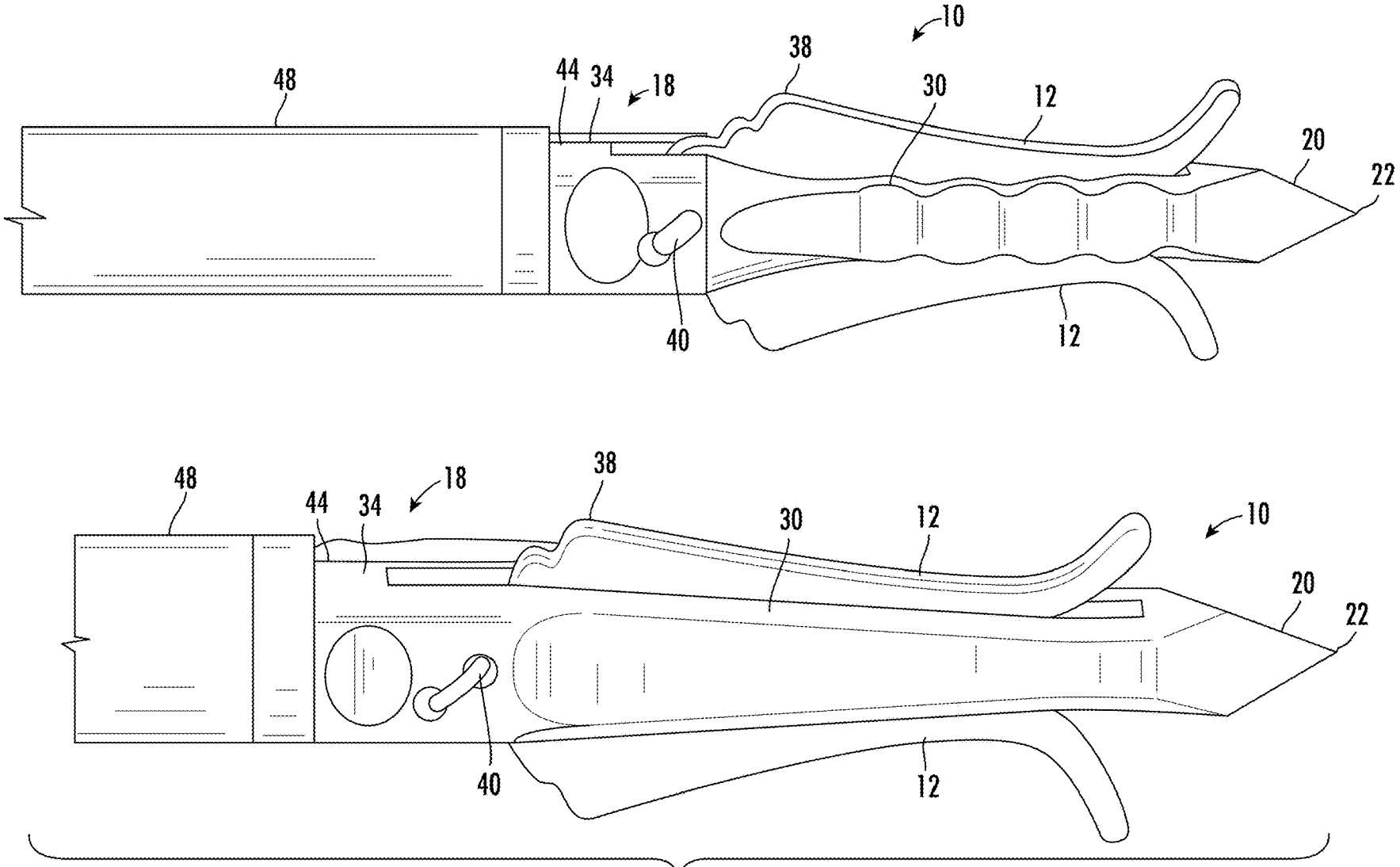
FIG. 11 is a side perspective view of the multiple broadheads with a receiver aligned with a longitudinal axis of the broadhead in each broadhead, whereby the receiver is a slot. The broadheads are in a closed position.
Figure 12:
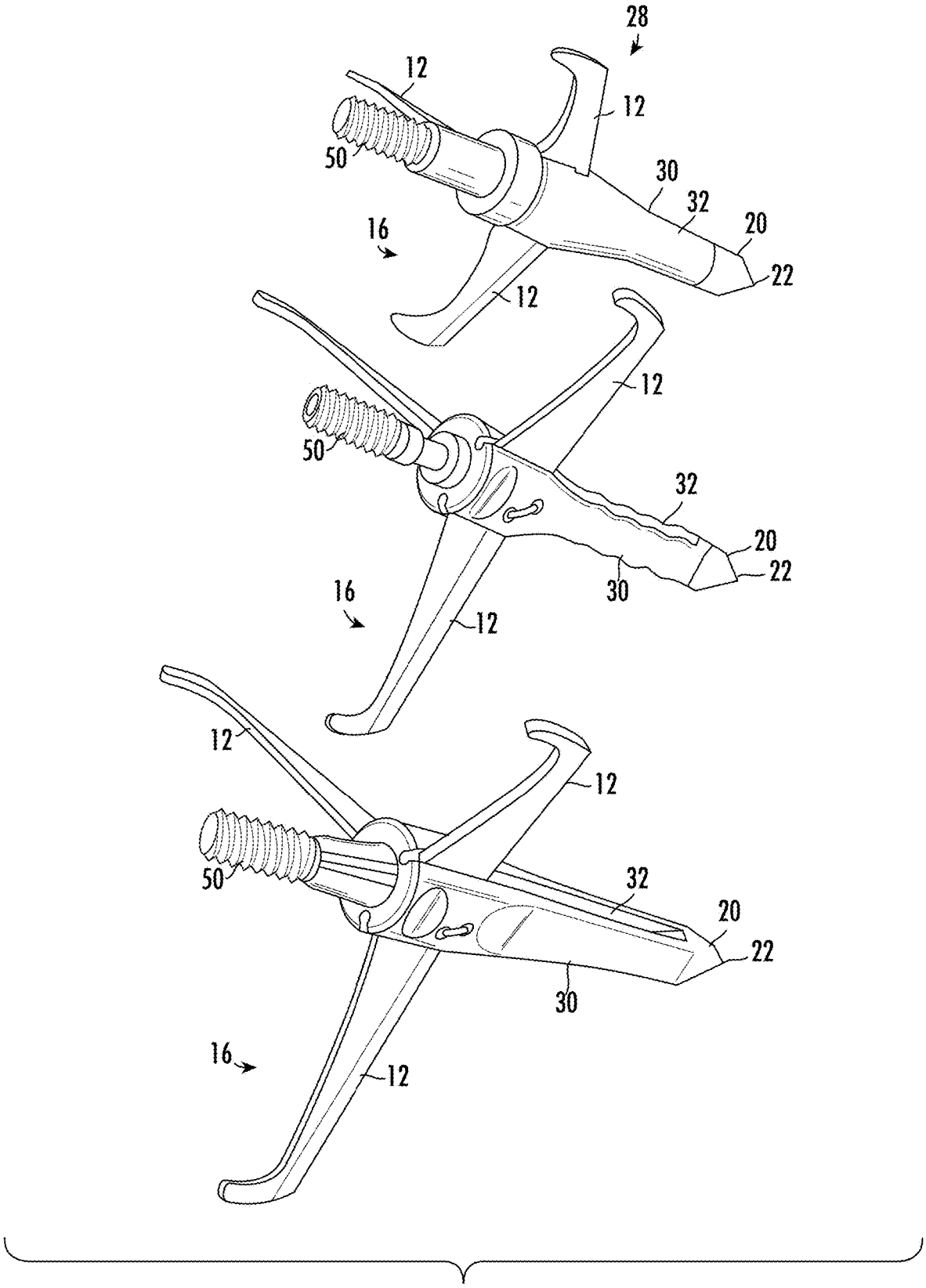
FIG. 12 is a rear perspective view of the broadheads with the blades deployed in open positions and a dampening body positioned with a receiver, which is a slot in each of the broadheads.

In another embodiment, as shown in FIGS. 8-13, another embodiment of the blade shock absorption system 18 is disclosed. The blade shock absorption system 18 may be configured such that the dampening body 34 is positioned differently relative to the broadhead body 30 than the embodiment previously disclosed herein. In particular, the dampening body 34 may be positioned within a receiver 44 having a longitudinal axis aligned with a longitudinal axis of the broadhead 10 and extending through a proximally facing abutment surface of the broadhead 10 into the slot receiving a blade 12 in a closed position. In at least one embodiment, the receiver 44 may be a slot having at least one side open and exposed to the ambient environment such that a user can get access to a dampening body 34 position in the slot. In yet another embodiment, the receiver 44 may be a hole. In at least one embodiment, the dampening body 34 may be monofilament. In such embodiment, the receiver 44 may be filled with a piece of monofilament that extends generally from the proximally facing abutment surface of the broadhead 10 and to the slot receiving a blade 12 in a closed position, as shown in FIGS. 9 and 10. During use, as a blade 12 contacts material, such as an animal hide, the blade 12 rotates about the pivot point on the broadhead 10 and once nearly in the open position 16, a portion of the blade 12 contacts the monofilament positioned within the receiver 44 and exposed to the blade 12. The monofilament dampens the stop that the blade 12 undergoes. Such configuration of the receiver 44 extending through the proximally facing abutment surface of the broadhead 10 enables easy replacement of the monofilament after the broadhead 10 has been used.

Figure 14:
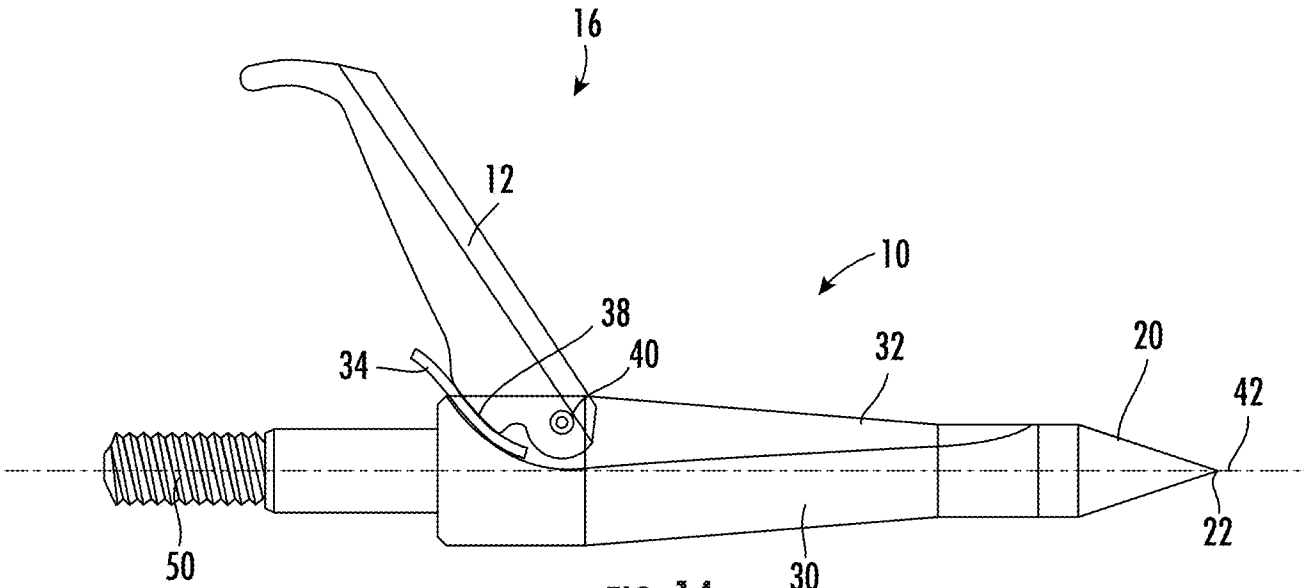
FIG. 14 is a side view of the broadhead with another embodiment of the dampening body, whereby the broadhead includes a blade in the open position where the blade is contacting a dampening body formed from a bendable material.
Figure 15:
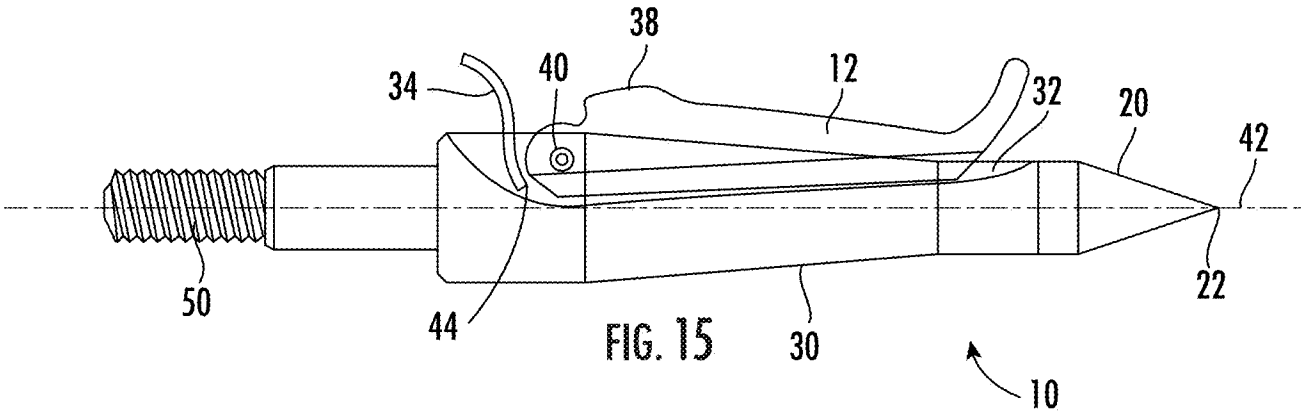
FIG. 15 is a side view of the broadhead of FIG. 14 with the blade in a closed position in which the blade is not in contact with the dampening body.

As shown in FIGS. 14 and 15, the dampening body 34 may be retained such that the dampening body 34 extends from the broadhead body 30. In at least one embodiment, the dampening body 34 may extend at least somewhat radially outward. In at least one embodiment, the dampening body 34 may be extend from the broadhead body 30 generally nonorthogonal and nonparallel to a longitudinal axis 42 of the broadhead body 30. A radially outer end of the dampening body 34 may be nonparallel with an edge or surface of the blade contacting the dampening body 34. In at least one embodiment, the dampening body 34 may be positioned on the flat surface 38 on a proximal edge of a blade 12 in an open position 16. As such, when the blade contacts the dampening body 34 when moving from the closed 14 to the open position 16, the blade 12 causes the dampening body 34 to bend, thereby causing the dampening body 34 to absorb forces generated by the moving blade 12 and cushioning the blade 12 as the blade's movement is halted. In this embodiment, the dampening body 34 may be any appropriate length. In at least one embodiment, the dampening body 34 may be, but is not limited to being, between about 1/32 of an inch and about 1/4 of an inch in length. In another embodiment, the dampening body 34 may be between 1/16 of an inch an about 1/18 of an inch in length. The dampening body 34 may be attached to the broadhead body 30 in any appropriate manner. In at least one embodiment, the dampening body 34 may be partially positioned within a receiver 44 in the broadhead body 30 and may extending outwardly therefrom into the movement path of the blade 12.

Figure 16:
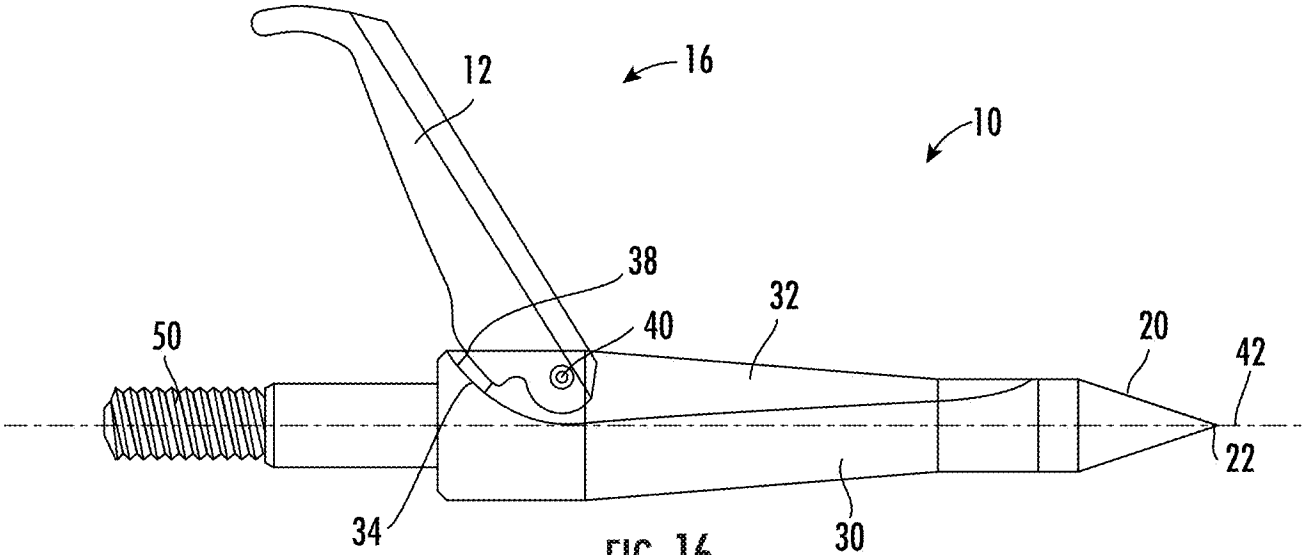
FIG. 16 is a side view of the broadhead with another embodiment of the dampening body, whereby the broadhead includes a blade in the open position with a dampening body attached to the blade.
Figure 17:
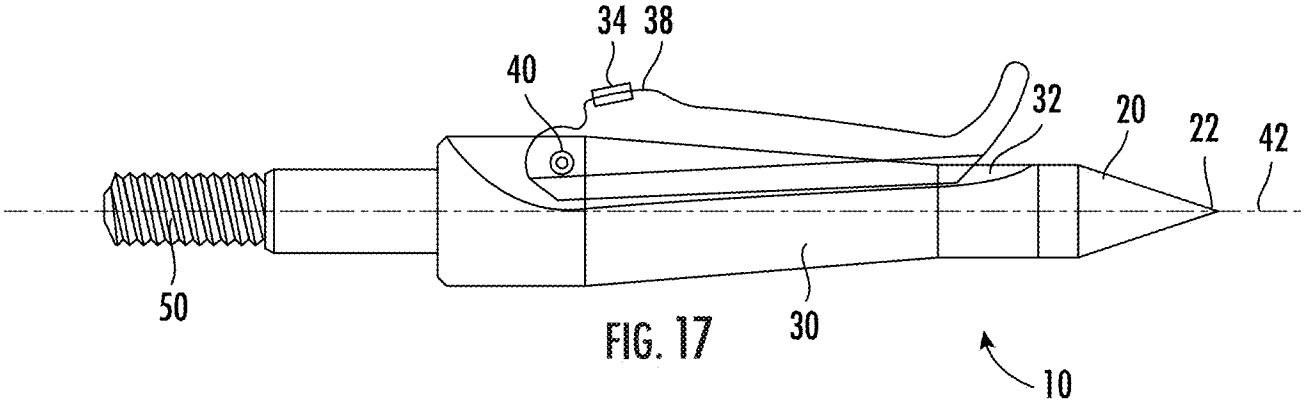
FIG. 17 is a side view of the broadhead of FIG. 16 with the blade in a closed position in which the dampening body is attached to the blade.

As shown in FIGS. 16 and 17, the dampening body 34 may be retained such that the dampening body 34 is attached to one or more blades 12. In at least one embodiment, the dampening body 34 may be attached to a blade surface 38 or edge in such a manner that the dampening body 34 contacts another portion of the broadhead before the blade 12 reaches the opened position. As such, the dampening body 34 will absorb forces of the blade 12 and slow the blade 12 to a halt without the blade 12 being damaged by absorbing all of the force. In at least one embodiment, the dampening body 34 may be positioned on a proximal facing surface 38 of the blade 12 in close proximity to a pivot point of the blade 12 relative to the body 30. The dampening body 34 may be positioned to contact a surface within the blade receiving slot 32. In other embodiments, the dampening body 34 may contact other aspects of the broadhead body 30.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A broadhead for an arrow, comprising:

a body configured to be attached to a distal end of the arrow;

a tip forming a distal end of the body;

at least one movable blade movably attached to the body;

wherein the at least one movable blade is configured to move between closed and open positions; and a blade shock absorption system configured to absorb forces generated within the at least one movable blade moving from the closed position to the open position causing the at least one movable blade to decelerate to the open position.

2. The broadhead of claim 1, wherein the blade shock absorption system comprises at least one dampening body positioned such that at least a portion of the at least one movable blade contacts the at least one dampening body when the at least one blade moves from the closed position to the open position.

3. The broadhead of claim 2, wherein the blade shock absorption system comprises at least one receiver configured to receive at least a portion of the dampening body and position the dampening body such that at least a portion of the at least one movable blade contacts a portion of the at least one dampening body when the at least one blade moves from the closed position to the open position.

4. The broadhead of claim 2, wherein the at least one dampening body is attached to the at least one blade.

5. The broadhead of claim 2, wherein the at least one dampening body extends at least partially radially outward from the body of the broadhead.

6. The broadhead of claim 2, wherein a longitudinal axis of the at least one receiver is aligned with a longitudinal axis of the body.

7. The broadhead of claim 2, wherein a longitudinal axis of the at least one receiver is orthogonal to a longitudinal axis of the body.

8. The broadhead of claim 2, wherein a longitudinal axis of the at least one receiver is nonorthogonal and nonparallel to a longitudinal axis of the body.

9. The broadhead of claim 2, wherein the at least one receiver is a slot with at least one open side.

10. The broadhead of claim 2, wherein the at least one receiver is a hole with an opening in at least one end of the hole.

11. The broadhead of claim 2, wherein the at least one dampening body is removably positioned in the receiver.

12. The broadhead of claim 2, wherein the at least one dampening body is constructed of a material that is more malleable than a material forming the at least one blade.

13. The broadhead of claim 1, wherein the at least one receiver is positioned between a point at which the at least one movable blade is movably attached to the body and a proximal end of the body.

14. The broadhead of claim 1, wherein the at least one movable blade further comprises a protrusion extending therefrom and positioned to contact at least one dampening body of the blade shock absorption system when the blade is moving from the closed position to the open position.

15. The broadhead of claim 1, further comprising a blade retention system configured to retain the at least one movable blade in a closed position.

16. A broadhead for an arrow, comprising:

a body configured to be attached to a distal end of the arrow;

a tip forming a distal end of the body;

at least one movable blade movably attached to the body;

wherein the at least one movable blade is configured to move between closed and open positions;

a blade shock absorption system configured to absorb forces generated within the at least one movable blade moving from the closed position to the open position causing the at least one movable blade to decelerate to the open position;

wherein the blade shock absorption system comprises at least one receiver and at least one dampening body positioned in at least a portion of the receiver;

wherein the at least one receiver is positioned such that at least a portion of the at least one movable blade contacts the at least one dampening body when the at least one blade moves from the closed position to the open position; and wherein the at least one receiver is positioned between a point at which the at least one movable blade is movably attached to the body and a proximal end of the body.

17. The broadhead of claim 16, wherein the at least one receiver is a slot with at least one open side.

18. The broadhead of claim 16, wherein the at least one dampening body is a crushable material.

19. The broadhead of claim 16, wherein the at least one dampening body is constructed of a material that is more malleable than a material forming the at least one blade.

20. A broadhead for an arrow, comprising:

a body configured to be attached to a distal end of the arrow;

a tip forming a distal end of the body;

at least one movable blade movably attached to the body;

wherein the at least one movable blade is configured to move between closed and open positions;

a blade shock absorption system configured to absorb forces generated within the at least one movable blade moving from the closed position to the open position causing the at least one movable blade to decelerate to the open position;

wherein the blade shock absorption system comprises at least one receiver and at least one dampening body positioned in at least a portion of the receiver;

wherein the at least one receiver is positioned such that at least a portion of the at least one movable blade contacts the at least one dampening body when the at least one blade moves from the closed position to the open position;

wherein the at least one dampening body is removably positioned in the receiver; and wherein the at least one receiver is positioned between a point at which the at least one movable blade is movably attached to the body and a proximal end of the body.

* * * * *